United States Patent [19]

Chipp et al.

[11] 3,958,747

[45] May 25, 1976

[54] TAMPERPROOF CONTAINERS

[76] Inventors: Douglas Frank Chipp, 3955 Belanger St., E., Apt. 407, Montreal 408, Quebec; Raymond Delorme, 4481 Gatineau, Chomedey, Laval, Quebec, both of Canada

[22] Filed: June 22, 1973

[21] Appl. No.: 372,490

[52] U.S. Cl. ..... 229/43; 229/23 R; 229/45 R; 229/51 TS

[51] Int. Cl.[2] ..... B65D 43/08

[58] Field of Search ..... 229/37 E, 43, 23 R, 229/44 R, 23 A, 45, 51 TS; 206/45.12, 45.34, 45.32

[56] References Cited

UNITED STATES PATENTS

| | | | |
|---|---|---|---|
| 2,370,927 | 3/1945 | Anderson | 229/45 |
| 2,420,773 | 5/1947 | Dorfman | 206/45.12 |
| 2,577,248 | 12/1951 | James | 229/45 |
| 2,902,202 | 9/1959 | Fallert | 229/45 X |
| 3,338,505 | 8/1967 | Hughes | 229/45 X |
| 3,670,951 | 6/1972 | Smith | 229/43 |
| 3,692,231 | 9/1972 | Neitzke | 229/45 |

FOREIGN PATENTS OR APPLICATIONS

| | | | |
|---|---|---|---|
| 193,299 | 1/1957 | Austria | 229/43 R |
| 71,067 | 7/1942 | Czechoslovakia | |

*Primary Examiner*—Richard E. Aegerter
*Assistant Examiner*—Stuart S. Levy
*Attorney, Agent, or Firm*—Robert J. Schaap; Ian Fincham

[57] ABSTRACT

There is provided a container which combines the features of "knockdown" type containers and rigid type containers characterized by having a knockdown body portion and separate strengthening and retaining members for retaining the body in an assembled condition when it is erected.

17 Claims, 11 Drawing Figures

44
30
44
42
46
46
22
22
46
46
44
30

30
44
42
2
3
3
2
10
14
22
22
22
30
42
46

40
46
44
44
42
42
30
20
28
20
28
20
26
26
22

42
30
14
22
22
12
14
12
12
22
22
12

44
30
42
20
46
22

TAMPERPROOF CONTAINERS

This invention relates to containers.

More particularly, this invention relates to containers for the transportation and storage of commodities, which are of a type having improved rigidity characteristics, as well as other advantageous features as described hereinafter.

Shipping and display containers normally comprise a body, which may be of rectangular, cylindrical or other geometrical configuration, adapted to retain at least one commodity, together with a bottom wall and a top wall. In effect, such containers are basically of one of two types — either "knockdown" or rigid type. The first of these basic types of containers, as the term implies, has a structure which permits it to be flattened or collapsed so that after manufacture, it may be shipped to the user in flattened condition, whereafter the user will erect the container and load it with a commodity. The second or rigid type of container is normally constructed so that it is "permanently" assembled and is not structurally capable of being knocked down for shipping purposes. Rigid type of containers normally have greater strength characteristics than the knockdown type, permitting them to be used for applications where strength characteristics are required in deference to the knockdown type of container. Conversely, knockdown type of containers are limited in their application to situations where the container is not likely to be subjected to forces which will collapse it, and possibly damage the contents.

With this invention, applicant has developed a structure for a container which combines the advantageous features of both the rigid and knockdown types of containers, but without their inherent disadvantages.

More particularly, in accordance with this invention, there is provided a container which includes a body portion adapted to retain one or more commodities, an opening in said container adapted to permit loading of one or more commodities into said body portion, and closure means for said aperture to close said container, said closure means comprising a strengthening and retaining member adapted to prevent said container from collapsing, said member comprising a rigid reinforcing member having a side wall, and an inwardly turned flange extending inwardly of said side wall adapted to form a bearing and engaging surface, said container body having an outwardly turned flange portion when in an assembled condition, at least partially surrounding said aperture whereby said flange of said strengthening member, when said strengthening member surrounds said aperture, is adapted to engage the flange of said body.

More particularly, a preferred form of a container according to this invention, particularly useful for display purposes, comprises a body portion having opposed end portions, said body portion being of a knockdown type wherein said body portion includes a pair of opposed end portions, each of said end portions including an end flap extending from an end margin of the body portion at said opposed openings, said end flap preferably being of a continuous nature and substantially surrounding said aperture. However, in the case of rectangularly shaped containers with a rectangularly shaped opening, the end flap may extend only partially around the opening or alternately, on opposed sides.

Still further, means are preferably provided in the container body for defining the end flap, such means comprising a fold line, crease line or the like in the material to facilitate folding of the flap exteriorly of the opening in the container body. In the case of rectangular, triangular or other similar geometric configurations of container bodies and corresponding openings in the container bodies, the term "continuous" in describing the flaps is intended to denote that the flaps may be interrupted by notches or the like to permit exterior folding of the flaps without gathering of the material at corners of the container. Thus, the flap should it be continuous about the container opening, may be "V notched" or otherwise slit to permit continuous and uniform folding of the flap.

The end flaps of the container preferably have a depth corresponding substantially to the depth of the side wall of the strengthening and reinforcing means, as described above and hereinafter. Thus, in a folded down condition, the end flaps of the container body surrounding the opening should have a depth just slightly less than that of the height of the side wall of the reinforcing member.

For most purposes, and for economical reasons, the end flaps of the container body surrounding the opening therein should be derived from the material forming the container body per se. However, if desired, the container body may be manufactured as one unit and, a separate structure including end flaps may be attached to or otherwise mounted on the container body surrounding the container opening, which additional attachment will include the end flaps.

Thus, in the products of the present invention, the closure means for the openings of the container are characterized by forming one of the engaging means by which the closure means are secured in position surrounding the opening(s) of the container, by virtue of the flange of the strengthening and reinforcing member extending inwardly from the side walls thereof; the other cooperating engaging means being formed by the outwardly extending flange members of the body portion of the container have end margins which are adapted to engage the inwardly extending flange portion of the strengthening member. In this manner, there is formed a secure "lock" and depending on the type of material from which the flange members of the body portion are formed (i.e. depending on its rigidity), a substantially tamper-proof container may be provided whereby tampering or attempted theft of the contents of the container may be visually determined by bending of the closure means or of the flanges of the container body.

The strengthening member used to form the closure means for the containers of the present invention is preferably of a one-piece construction and, made from a "rigid" material. In this respect, the term rigid as used to describe the type of material from which the strengthening member is made denotes that such material is self-supporting and is preferably of a non-flexible nature (particularly for use in containers of a "tamper-proof" nature); although in the case of conventional packaging wherein tamper-proof characteristics are not required, the strengthening member may be made from somewhat flexible material.

The strengthening member, as such, is employed to retain the body of the container in an assembled or "set-up" condition, once the latter has been erected from a knock down condition, and to maintain the configuration of the container, particularly in the case where the body of the container is made from various types of non-rigid material. To this end, the structure of the reinforcing member, in a preferred form, includes a continuous side wall having an overall outline conforming to the opening of the container and being dimensioned so as to encompass and surround said opening. Thus, structurally, the strengthening member may have a rectangular, circular or any other geometrical configuration depending on the configuration of the aperture or opening in the container body. Attached to the side wall of the strengthening member is an inwardly turned flange, preferably integrally connected thereto, and desirably extending substantially at right angles thereto. The flange will extend inwardly a depth sufficient to provide a bearing and engaging surface for the flange of the container body surrounding the opening therein. To this end, the depth of the flange will also vary depending on the characteristics of the flange surrounding the container opening; in the case of relatively stiff materials, the flange may be narrower in width compared to rather flexible materials which form the flange of the container body (since greater leeway has to be given to provide an engaging surface depending on the extent to which the flange of the container body may flex and yet still engage the flange of the strengthening member). Likewise, for aesthetic purposes, it may be desired to provide a relatively wide flange so as to provide a wide base and/or top to the container. Typical widths for the flange are from about 1/32nd of an inch to ½ inch; commercially, satisfactory results (depending on the type of materials from which the cooperating flange of the container body is made) have been obtained using flanges of from 1/16th of an inch to ¼ inch.

The flange attached to the strengthening member preferably is substantially continuous and coextensive with the side walls of the strengthening member. However, if desired, the flange may be intermittent or may extend only on certain sides of the opening to correspond to both sides of the container opening which have cooperating mating flanges. In a preferred form, in most cases, the flange of the strengthening member is continuous with the flange attached to the opening of the container body.

Structurally, the strengthening member also preferably includes a second inwardly extending flange opposed to the flange adapted to engage the cooperating mating flange surrounding the container opening. This second flange is likewise located at substantially right angles to the side walls of the strengthening member; however, like the first flange, this may vary to include angles of an acute nature. The purpose of this second flange is to provide a bearing surface adapted to engage the rim surrounding the container opening and to prevent any "play" or free movement of the strengthening member when it is located in position surrounding the opening of the container. Further, as described hereinafter, the second flange may also provide a bearing surface adapted to receive a cover portion forming the end closure of the container.

The strengthening member, having regard to the above description, is thus preferably made of extruded metallic material, or in the alternative, extruded rigid plastic material. Once extruded, it may be shaped to the desired configuration and size of the container opening; to form a continuous one-piece strengthening member, suitable means may be included at both free ends of the strengthening member of the two ends to be joined together.

The body portion of the container of the present invention may be of any conventional construction — and to this end, it may be formed of a continuous or discontinuous wall structure. In other words, the body portion may be of a one-piece sheet material construction in which the opposed ends or opposed sides of the sheet are joined together by suitable means to form an enclosure adapted to contain or retain at least one commodity. In the case of the body per se being made up of several wall members, the individual wall members may be joined by suitable means, e.g. an adhesive or the like, to form a continuous wall structure. The geometrical configuration of the wall structure may be again any conventional shape, such as rectangular, triangular or circular. In this respect, the structure of the body portion of the container will preferably have one or more pairs of opposed fold lines adapted to permit the body to be collapsed, which fold lines may define the geometrical configuration of the container.

Conventionally, most containers used today are made of paper, paperboard or the like material and, as with conventional containers, the products of the present invention may likewise be made of any suitable conventional material. In addition to paperboard and the like material, and depending on the end use of the container, the containers of the present invention may be made of other materials such as resinous materials, e.g. cellophane, polyethylene, polypropylene, copolymers of the latter materials, metal foils, or laminates of plastic materials and metal foils or paper materials, etc. It will be understood that for most applications, the containers will be made of self-supporting materials and to this end, the thickness of the different materials which may be employed for constructing the containers will vary not only in this factor, but also it will depend on other factors such as weight, economics, etc. Thus, typical material thicknesses will vary from, e.g. 1 mil to 10 mils or more. It should also be pointed out, in this respect, that when using paper, paperboard or metal foils or the like, fold lines in the material forming the container body can be provided by appropriate mechanical means well known to those skilled in this art; however, in the case of various types of plastic or resinous materials, in which the materials have the characteristic of being collapsible without the necessity of fold lines, the fold lines need not be applied. This type of material, e.g. polyethylene or certain types of celluloid materials, may thus be collapsed without the necessity of the provision of fold lines and, when it is desired to assemble the container, the collapsed material will be reassembled into the form in which it was initially produced or manufactured without deleterious effects.

If desired, the body portion, or for that matter, the end portion(s) of the container may include one or more apertures for permitting visual inspection of the contents of the container — such apertures normally being covered by suitable transparent sheet material such as cellophane, plastics, particularly the thermoplastic material such as transparent polyethylene, transparent polypropylene, etc. To this end, the size and configuration of the aperture may vary and any suitable means may be provided for securing the transparent "window" material to the body of the container.

The products of the present invention may be made on existing equipment suitably modified, insofar as the individual components are concerned other than the strengthening and reinforcing member. Thus, in the case where the body of the container is made from a single piece of continuous sheet material, such as paper or paperboard, the appropriate blank for the container may be die cut from the sheet material and subsequently processed by providing the necessary fold lines, score lines, etc. In the case where the body is made of plastic material, the said plastic material may be extruded in the form of the container desired — or in the alternative, the plastic material when provided in sheet form, may be thermo-molded or thermo-formed into the desired configuration. Conventional assembly steps may then be employed to assemble the die cut blanks, or in the case of non-thermo-formed components, to assemble the same into a finished container. In this respect, following assembly or formation of the container and placing the same into a knockdown condition, the latter may then be re-erected, where and as required, and the strengthening member then inserted into juxtaposition into one or both ends of the container, depending on how the container is structured. Thus, for example, the knockdown body portions of a container can be manufactured and shipped to a user of the container, together with an appropriate number of strengthening members which the user will then merely "snap" into place after one or more commodities have been inserted into the container for packaging purposes. On the other hand, these containers can be manufactured, with the commodities being directly inserted into the body of the container and the reinforcing member inserted to provide a finished product at the site of manufacturing the container.

In general, the containers of the present invention may be used for various purposes — in general, they will find wide application in the consumer packaging industry wherein one or more commodities are adapted to be retained, shipped and displayed in the same container. Thus, by way of specific example, transparent containers, or containers having one or more apertures with a transparent protective sheet, may be used for shipping and displaying perfumes, liquor bottles, jewelry, etc. In a preferred usage of the containers of the present invention, the containers would be made of a generally non-flexible material (that is, the bodies of the containers are made of sufficiently rigid board or the like material such that when the strengthening members are incorporated into the structure of the container, there is provided a tamper-proof container. In this form of the invention, the strengthening member which meets with the extending flange portions of the body of the container will provide a positive seal to prevent access to the contents of the container — the container being otherwise provided with a line of weakened resistance to tearing or perforation whereby when it is desired to remove the contents of the container, the line of weakened resistance may be torn or otherwise ruptured thereby permitting access to the container contents. Once the line of weakened resistance is ruptured or broken, with access otherwise not being permitted by the closure means, the container may then become a hinged top container by providing a fold line in one of the walls of the container. In this sense, the container may also be used as a reusable product.

The containers of the present invention have many advantageous features over the prior art containers as well as evident from the above and substantially described preferred embodiments. Thus, knockdown type containers may be provided with simple means for retaining the container in a set-up condition once erected; while also at the same time providing a tamper-proof container.

Having thus generally described the invention, reference will now be made to the accompanying drawing illustrating preferred embodiments and in which.

Figures 1, 2, 3, 4, 5:
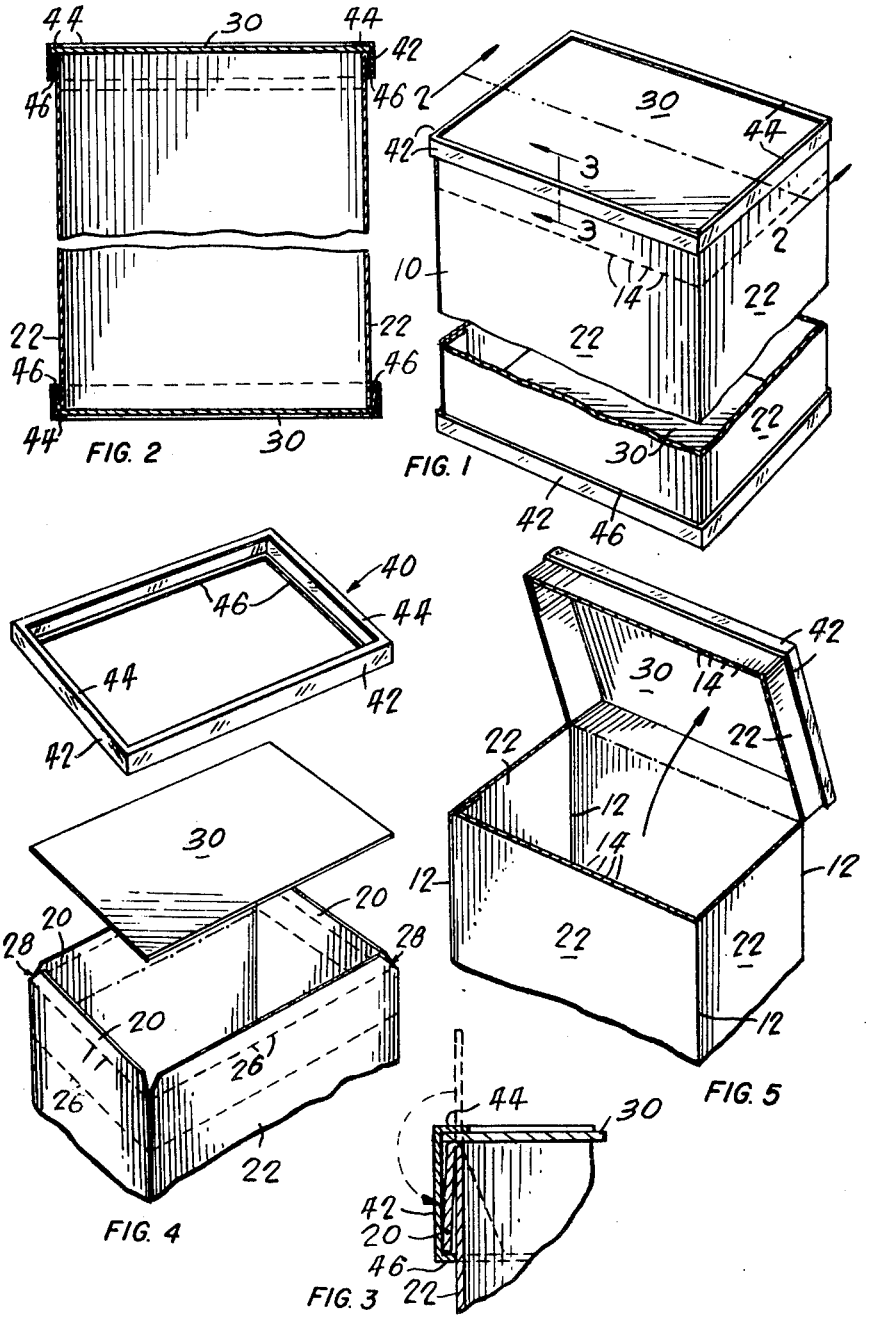
FIG. 1 is a perspective view of a typical container according to the present invention.
FIG. 2 is a section taken along the line 2—2 of FIG. 1.
FIG. 3 is a section taken along the line 3—3 of FIG. 1.
FIG. 4 is an exploded perspective view of one end of a container of the present invention showing the detailed structure of the container body, the bottom closure member and the strengthening member.
FIG. 5 is a perspective view of one end of the container of the present invention showing the same in an "open" condition.
Figure 6:
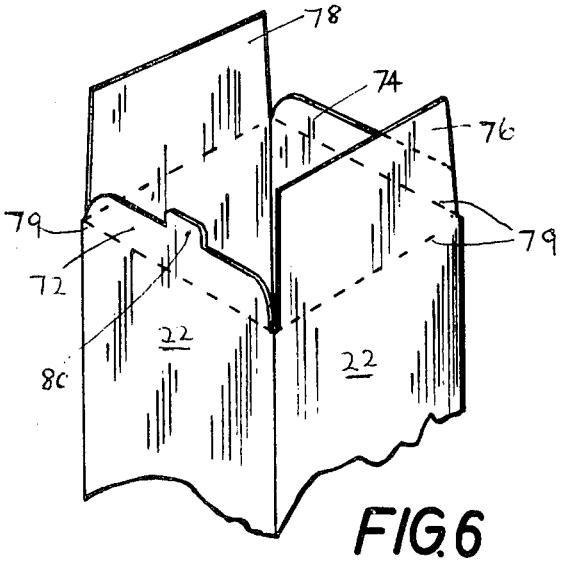
FIG. 6 is a perspective view of one end portion of a container construction showing the construction of the end of the container for this modification.

Referring now to the drawings in detail, the container includes a body portion indicated generally by reference numeral 10; the body portion in this embodiment consisting of a one-piece sheet material die-cut and scored in the form of a rectangular panel, with the free ends of the rectangular panel being joined along a seam line (as shown in FIG. 5) by suitable means (e.g. an adhesive). Again, in the specific embodiment illustrated, the body is of a generally rectangular configuration, the score lines indicated generally by reference numeral 12 permitting the container body 10 to be collapsed upon its production (which may be carried out by any conventional means) for shipping and transportation to a point of use. Again, the preferred embodiment illustrated depicts the container provided with a plurality of score lines indicated generally by reference numeral 14 in three consecutive panels thereof, to permit the container to be opened and access to the contents of the container body provided for. These score lines may be of a conventional construction, well known to those skilled in this art.

Both ends of the container in the illustrated embodiment are of an identical construction and each comprises a lower end portion of flange 20 foldably secured to the respective side walls, hereinafter identified by reference numeral 22. In this respect, a fold or crease line, or still further, score lines as indicated by reference numeral 26, may be used to define the flanges 20 and permit the same to be folded about the score line. If desired, the respective corners of the container may be V notched as indicated generally by reference numeral 28, to permit easier collapsing of the container for transportation and handling purposes, as well as permitting easier assembly of the latter. As described hereinbefore, the container body 22 may be of any suitable length and material; if desired, one or more of the panels may include apertures therein to permit visual inspection of the contents of the container.

The top and bottom portions of the container structurally comprise top and bottom panels indicated generally by reference numeral 30, which are of a size sufficient to substantially enclose the area between the pairs of opposed side walls 22. Each top and bottom closure panel may be of a similar material to that of the container body — e.g. cardboard or the like.

In addition, there is provided a strengthening and reinforcing member indicated generally by reference numeral 40 and comprising a one-piece continuous length of metal, plastic or the like material. The member 40 comprises a side wall portion 42, a top flange portion 44, and a bottom flange portion 46. The member 40 may be derived from a one-piece continuous length of extruded material, and die-cut and/or pressure formed to be of a generally rectangular configuration. Preferably, at the points where the metal trim or extrusion is adapted to be formed into 90° angles (in the case of rectangularly-shaped containers), V notches are provided to compensate for increased metal thickness at the respective corners of the rectangular metal member. Still further, the respective free ends of the one-piece member 40 may be joined by any suitable means, which will depend on the nature and type of material being employed to form the trim. In one preferred form, the length of metal trim is provided with cooperating mating locking means whereby the latter may be readily and easily assembled so that the respective locking means on either end of the metal trim 40 may be pressed together to form an effective and secure lock.

For use, the bottom and top panels 30 are inserted into their respective components 40 (the bottom and top panels 30 being of a size sufficient to be engaged by one or both of the metal flange members 44 and 46, which are turned inwardly at right angles to the respective side walls 42 to form L-shaped flanges). In this manner, the panels 30 are retained by the assembled members 40. As such, the assembled members 30 and 40 may be shipped as a separate component to the collapsed containers 10 and assembled when it is desired to package one or more commodities in the container 10.

For assembly purposes, the terminal flange portions 20 of the container walls 22 are outwardly turned (as shown in FIGS. 2 and 3) and the assembled member 40 with its respective bottom or top panel "snapped" over the outwardly turned flange portions 20 to permit the latter to engage with the bottom or top flanges 44 or 46 (depending on whether it is the top or bottom of the container) in the manner shown in FIG. 3. As illustrated, the flanges 20 of the container walls 22, due to their resilient nature and the dimensioning of the trim 44, tend to be urged outwardly and thus provide a firm and positive lock. As will be obvious from this description and the illustrations of the drawings, the strengthening and reinforcing members 40 at the top and bottom of the container will thus provide a non-collapsible container capable of retaining its shape with a commodity therein, and further, of preventing access to the contents of the container without visually damaging the ends of the container. Then, following packaging of the commodity in the container, when it is desired to remove the commodity from the container, the score, slit or like weakened lines in the container body 22, which are indicated by reference numeral 14, may be cut or broken and the container may be used as a hinge top container if desired (in this case, there may be provided a further weakened line indicated generally by reference numeral 33 in the wall of the container which does not include the perforated or weakened lines 14.

Figure 7:
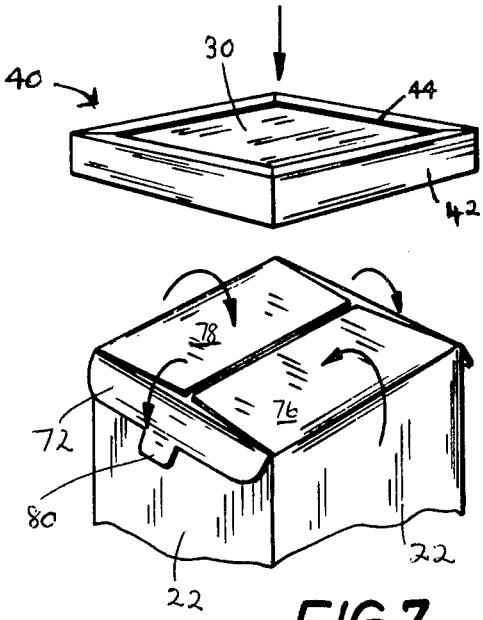
FIG. 7 is a view similar to FIG. 6 but illustrating the method of assembly of the end closure.
Figure 8:
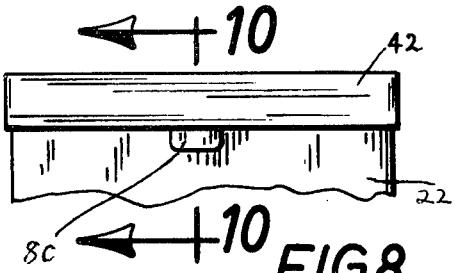
FIG. 8 is a partial side elevational view of the end construction of a container having the closing means.

Referring now to FIGS. 6 to 11, in greater detail, similar reference numerals used in FIGS. 1 to 5 have been used to designate similar components in FIGS. 6 to 11. Thus, the end closure means as illustrated in FIG. 7 includes a one-piece strengthening and retaining member indicating generally by reference numeral 40 and which includes a side wall portion 42 and a top flange portion 44, together with a bottom flange member 46. A one-piece closure panel 30 is inserted into the assembled component 40 to provide a closure between the open area defined by the members 40 and 42.

The inwardly turned flange portion 46 of the strengthening and retaining member 40, is provided on one wall with a cut-out portion, the cut-out area being designated generally by reference numeral 70 (see FIG. 9), which cut-out portion 70 may vary in width anywhere from 1/16th to ⅛ of an inch and up to about 1 inch or more, depending on the type of container employed.

Figure 9:
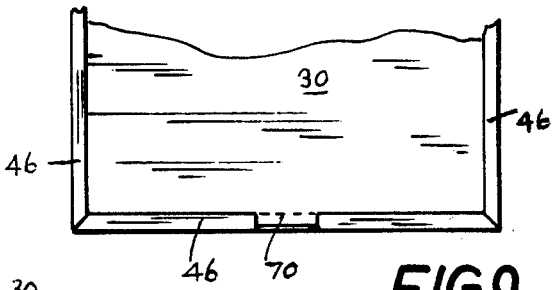
FIG. 9 is a partial bottom plan view of the strengthening and retaining member of FIGS. 7 and 8.

Normally, the cut-out portion 70 extends the full thickness of the flange 46 as shown in FIG. 9.

The body construction of the container is also somewhat different in that it includes end flaps 72 and 74 at the terminal margins of the side panels 22, and on opposed margins thereof. If desired, full panels 76 and 78 may also be included on the other pair of opposed walls 22 of the container — these may either be adapted to form a full bottom closure between the respective panels — alternately, only a single panel 76 or 78 may be included extending across the full width of the container — or still further, these panels need not be included depending on the type of article to be packaged in the container. Panels 72, 74, 76 and 78 may be connected along a fold or crease line indicated generally by reference numeral 79 to facilitate their folding action, as is conventional in this art.

Figure 10:
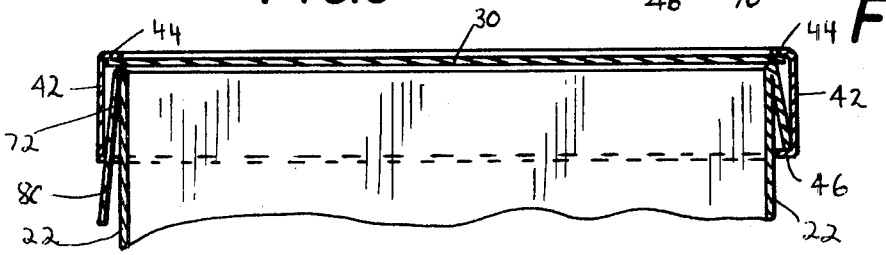
FIG. 10 is a section taken along the line 10—10 of FIG. 8.
Figure 11:
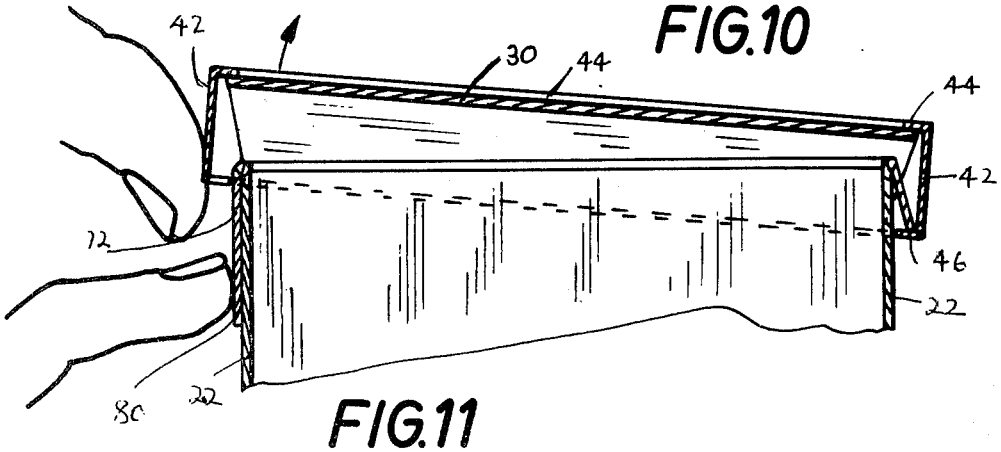
FIG. 11 is a view similar to FIG. 10 but showing one method of opening the end portion of the container.

As will be seen from FIG. 7, the end panels 76 and 78 are adapted to be folded inwardly of the container body; on the other hand, panels 72 and 74 are adapted to be folded outwardly as shown in FIGS. 7, 10 and 11. Panels 72 and 74 are constructed so as to have a depth, in the turn down condition (as shown in FIG. 7) which corresponds substantially to the depth or heighth of the side wall 42 of the strengthening and retaining member. The purpose of these panels 72 and 74 is to abut against the inwardly turned flange member 46 of the strengthening and retaining member 40, as shown in FIGS. 10 and 11, so as to secure the member 40 in juxtaposition with the end structure of the container and to provide a closure for the same.

In accordance with a further feature of this modification of the present invention, the panels 72 (or the panels 74 — or both) may be provided with a tab member 80 extending beyond the free edges of the panel 72 which otherwise lies in juxtaposition with the flange 47 when in an assembled condition. This tab member really is preferably of a size sufficient to correspond in width to the width of the cut-out portion 70 of the member 40 — and of a length sufficient to extend beyond the flange member 46 through the cutter portion 70 when the end closure is in an assembled condition — again, as shown in FIG. 10.

It will be understood, having regard to the above description, that both of panels 72 and 74 may be provided with the tab member 80 rather than only one as illustrated in the drawing; still further, all four body panels 22 of the container (in the case of a rectangular container as shown in the drawings) may be provided with panels similar to panels 72 and 74 which are adapted to be outwardly turned (in this case, there would not be any bottom closure channel for the container other than that provided by the end panel 30 which is sufficient for certain packaging applications). A still further alternative would be to provide three of the panels 22 with panels similar to panels 72 and 74, in which case at least one may contain the tab 80. There of course would be a corresponding number of cut-out portions 70 in the respective flanges 46. In the case of containers having more than four side panels, similar cut-out portions for more than one side may be provided with corresponding tabs for the panels 72 and/or 74.

To assemble a container, the closure panel 30 is inserted into the strengthening and retaining member 40 as described in the original disclosure and, if included, the panels 76 and 78 are inwardly turned while the panels 72 and 74 are outwardly turned — as shown in FIG. 7. Thereafter, the strengthening and retaining member 40 with the end closure panel 30 is pressed down and snapped into locking position over the end of the container with the cut-out portion 70 of the member 40 being located at the appropriate side with the tab 80, whereby the panels 72 and 74 abut the flanges 46 as shown in FIG. 10 to provide a locked end portion for the container. In this configuration, the tab 80 extends beneath the level of the flanges 46.

To remove the strengthening and retaining member 40, one method of doing this may be as illustrated in FIG. 11, wherein the tab 80 is pushed into proximity of juxtaposition with the side wall 22 of the container thereby to release the panel 72 from engagement with the inwardly turned flange 46 and permit the member 40 to be moved upwardly in a "hingeable" manner, and thereby to gain access to the contents. Still further, if desired, the tab 80 may be lifted upwardly to yieldably depress the panel 72 and permit the strengthening and retaining member to be removed from the container As illustrated in FIGS. 6 to 11, the panels 70 and 72 in an assembled condition fit into the strengthening and retaining member in the area defined by the side walls 42 and the bottom flange 46 in a manner such that the panels 70 and 72 are slightly angled (i.e. not in juxtaposition with the side panels 22). This provides additional locking strength — on the other hand, the strengthening and retaining member 40 may be dimensioned so as to snugly fit about the end of the container so that the panels 72 and 74 may actually be in close proximity to the side walls 22 of the container while still retaining the desirable locking action of the container of the present invention.

The container may be made of any suitable material according to the requirements known by those skilled in this art depending on the type of usage for the container. Similarly, the strengthening and retaining member may be made of the material described in the original disclosure or of plastic material (as in the case of a one-piece extrusion).

It will be understood that various modifications can be made to the above described embodiments without departing from the spirit and scope of the invention. Thus, triangular containers, octagonal container, etc. may likewise be constructed having the advantages of the present invention.

We claim:

1. A substantially tamperproof-type container where tampering of said container can be visually determined by bending of a body portion or bending of a strengthening and retaining frame forming part of the container, said container comprising in combination a knock-down body portion forming a cavity to retain a commodity therein, said body portion being of one piece construction formed by a self supporting material and having at least first and second body-forming walls, and each of said body-forming walls having end margins thereon, said body portion having an aperture communicating with said cavity to permit loading of a commodity therein, a first flap extending from the end margin on said first body-forming wall and capable of being struck in a direction where it lies substantially in juxtaposition to the exterior surface of said first body-forming wall, a second flap extending from the end margin on said second body-forming wall and capable of being struck in a direction where it lies substantially in juxtaposition to the exterior surface of said second body-forming wall, closure means operatively associated with said body portion to extend in closurewise position over said aperture, said closure means comprising a strengthening and retaining frame of one piece construction which has a shape substantially conforming to the shape of said body portion, said strengthening and retaining frame having a side wall formed of a reinforcing material, first and second flanges extending inwardly substantially perpendicularly from said side wall and being spaced apart from each other by a distance approximately equal to the length of said first flap, said first and second flaps each having a depth approximately equal to the depth of the side wall of said strengthening and retaining frame, said side wall of said strengthening and retaining frame being substantially parallel to said first and second body-forming walls when said closure means is in the closurewise position, the end margin of said first body-forming wall being operatively retained by the first flange on said side wall and the outer end of said first flap snuggly engaging the second flange on said side wall when said strengthening and retaining frame is assembled with said body portion, said first flange snuggly engaging the end margins of said first and second body-forming walls sufficiently to prevent play or free movement of the strengthening and retaining frame when surrounding the container body portion, the end margin of said second body-forming wall also being operatively retained by the first flange on said side wall when said member is assembled with said body portion, each of said first and second flaps being located in somewhat parallel relationship to said respective first and second body-forming walls but being slightly angularly located with respect to said body-forming walls when the closure means is shifted to the closurewise position, said second flange having a bearing surface which faces the first flange and retentively engaging the outer end of said first flap, said bearing surface having a width substantially greater than the thickness of the outer end of said first flap, said end margin on said first body-forming wall engaging said side wall and being retained by said side wall and said first flange when said strengthening and retaining frame is assembled with said body portion, said relatively slight angular relationship of said first flap to said first body-forming wall increasing the locking strength of said flap to said strengthening and retaining frame, to thereby provide a positive seal and an extended panel associated with said body-forming walls and which extends at least partially over said aperture and cooperates with said strengthening and retaining frame to facilitate in the closing of said aperture.

2. A container, as defined in claim 1, wherein said body portion is orthogonal in shape, the end margins on said first and second body-forming walls are upper end margins, said first and second flaps are struck downwardly to lie substantially in juxtaposition to the exterior surfaces of said first and second body-forming walls, and the flanges on said strengthening and retaining frame are upper and lower spaced apart flanges.

3. A container, as defined in claim 1, wherein said body portion includes opposed ends, each of said ends having apertures therein communicating with said cavity, said body portion having at least a pair of flaps at one of said ends which at least partially encircle said aperture, said flaps being adapted to engage the flanges of strengthening and retaining frames at each of said opposed ends.

4. A container, as defined in claim 1, wherein the flaps attached to the body portion of said container are integrally connected to said body portion and completely encircle said aperture.

5. A container, as defined in claim 1, wherein said strengthening and retaining frame comprises a one-piece continuous substantially rigid body adapted to encircle the aperture of the body portion of said container, the flanges of said one-piece member being substantially coextensive with the flaps attached to the body portion of said container surrounding said aperture, the flanges on said strengthening and retaining frame being in engagement with substantially all of the flaps on the body portion to thereby mount said strengthening and retaining frame to surround said body portion.

6. A container, as defined in claim 1, wherein said strengthening and retaining frame comprises a one-piece reinforcing member having a side wall, said side wall having inwardly turned upper and lower flanges and forming a U shaped channel with said side wall, said side wall having a depth substantially equal to the length of the first slap surrounding said aperture on the body portion.

7. A container, as defined in claim 1, wherein said body portion is formed from a plurality of (quadrilaterally) rectangularly arranged body-forming walls, said body-forming walls being foldable about a plurality of fold lines to provide a knockdown container.

8. A container, as defined in claim 1, wherein said container includes a closure panel means adapted to be received by said strengthening and retaining member, said closure panel means being of size sufficient to substantially close the aperture of said body and being adapted to be retained by said strengthening and retaining frame, whereby when said strengthening and retaining frame is placed about said opening with the flaps on said body portion operatively engaging the flanges of said strengthening and retaining frame, said closure panel means is effective to substantially close the aperture of said container.

9. A container, as defined in claim 8, wherein said closure panel means includes one closure panel extending dimensioned so as to be received by said strengthening and retaining member with said panel being adapted to be folded in an outwardly hinged manner relative to the container body.

10. A container, as defined in claim 8, wherein said container body comprises at least two of said body-forming walls opposed having extension panels therefrom and surrounding said aperture for the container body.

11. A container, as defined in claim 1, wherein said body portion includes integrally connected additional end flaps, said additional end flaps being adapted to be folded about a fold or crease line and extend interiorly of said body portion.

12. A container, as defined in claim 1, wherein the second flap has an outer end margin which engages the second flange on said side wall when said strengthening and retaining frame is assembled with said body portion, and an extended tab integrally formed with and extending from the outer end margin of said second flap.

13. A container, as defined in claim 12, wherein said strengthening and retaining frame includes an aperture therein sized to permit the tab to extend therebeyond.

14. A container, as defined in claim 1, wherein said side wall is formed of a rigid reinforcing material which is different than the material in said body portion.

15. A substantially tamperproof-type container where tampering of said container can be essentially visually determined by bending of a body portion or bending of a strengthening and retaining frame forming part of the container, said container comprising in combination a knock-down body portion forming a cavity to retain a commodity therein, said body portion of one piece construction formed of a self supporting material and having at least first and second body-forming walls, and each of said body-forming walls having end margins thereon, said body portion having an aperture communicating with said cavity to permit loading of a commodity therein, a first flap extending from the end margin on said first body-forming wall and capable of being struck in a direction where it lies substantially in juxtaposition to the exterior surface of said first body-forming wall, a second flap extending from the end margin on said second body-forming wall and capable of being struck in a direction where it lies substantially in juxtaposition to the exterior surface of said second body-forming wall, closure means operatively associated with said body portion to extend in closurewise position over said aperture, said closure means comprising a strengthening and retaining frame of one piece construction which has a shape substantially conforming to the shape of said body portion, said strengthening and retaining frame having a side wall formed of a reinforcing material, first and second flanges extending inwardly substantially perpendicularly from said side wall and being spaced apart from each other by a distance approximately equal to the length of said first flap, said first and second flaps each having a depth approximately equal to the depth of the side wall of said strengthening and retaining frame, said side wall of said strengthening and retaining frame being substantially parallel to said first and second body-forming walls when said closure means is in the closurewise position, the end margin of said first body-forming wall engaging the first flange on said side wall and the other end of said first flap snuggly engaging the second flange on said side wall when said strengthening and retaining frame is assembled with said body portion, said first flange snuggly engaging the end margins of said first and second body-forming walls sufficiently to prevent play or free movement of the strengthening and retaining frame when surrounding the container body portion, the end margin of said second body-forming wall also engaging the first flange on said side wall when said member is assembled with said body portion, each of said first and second flaps being located in somewhat parallel relationship to said respective first and second body-forming walls but being slightly angularly located with respect to said body-forming walls when the closure means is shifted to the closurewise position, said second flange having a bearing surface which faces the first flange and retentively engaging the outer end of said first flap, said bearing surface having a width substantially greater than the thickness of the outer end of said first flap, said end margin on said first body-forming wall engaging said side wall and being retained by said side wall and said first flange when said strengthening and retaining frame is assembled with said body portion, said relatively slight angular relationship of said first flap to said first body-forming increasing the locking strength of said flap to said strengthening and retaining frame, and extended portion on said second flap which extends beyond the second flange on said side wall which is capable of being manually grasped and pulled for permitting removal of the strengthening and retaining frame from the body portion.

16. A substantially tamperproof-type container where tampering of said container can be essentially visually determined by bending of a body portion or bending of a strengthening and retaining frame forming part of the container, said container comprising in combination a knock-down body portion forming a cavity to retain a commodity therein, said body portion being of one piece construction formed of a self supporting material and having at least first and second body-forming walls and each of said body-forming walls having end margins thereon, said body portion having an aperture communicating with said cavity to permit loading of a commodity therein, a first flap extending from the end margin on said first body-forming wall and capable of being struck in a direction where it lies substantially in juxtaposition to the exterior surface of said first body-forming wall, a second flap extending from the end margin on said second body-forming wall and capable of being struck in a direction where it lies substantially in juxtaposition to the exterior surface of said second body-forming wall, a strengthening and retaining closure frame of one piece construction and adapted to extend in closurewise position over said aperture and which frame has a shape substantially conforming to the shape of said body portion, said strengthening and retaining closure frame having a side wall formed of a reinforcing material, first and second flanges extending inwardly substantially perpendicularly from said side wall and being spaced apart from each other by a distance approximately equal to the length of said first flap, said first and second flaps each having a depth approximately equal to the depth of the side wall of said strengthening and retaining frame, said side wall of said strengthening and retaining closure frame being substantially parallel to said first and second body-forming walls when said closure means is in the closurewise position, the end margins of said first and second body-forming walls engaging the first flange on said side wall and the outer end of said first and second flaps snuggly engaging the second flange on said side wall when said strengthening and retaining closure frame is assembled with said body portion, said first flange snuggly engaging the end margins of said first and second body-forming walls sufficiently to prevent play or free movement of the strengthening and retaining frame when surrounding the container body portion, each of said first and second flaps being located in somewhat parallel relationship to said respective first and second body-forming walls but being slightly angularly located with respect to said body-forming walls when the closure means is shifted to the closurewise position, said second flange having a bearing surface which faces the first flange and retentively engaging the outer end of said first flap, said bearing surface having a width substantially greater than the thickness of the outer end of said first flap, said end margin on said first body-forming wall engaging said side wall and being retained by said side wall and said first flange when said strengthening and retaining frame is assembled with said body portion, said relatively slight angular relationship of said first flap to said first body-forming wall increasing the locking strength of said flap to said strengthening and retaining frame, and means forming a continuous score line extending across at least one of said body-forming walls and which is spaced from said strengthening and retaining closure frame, said score line being capable of being manually opened to provide access to the container cavity.

17. A substantially tamperproof-type container where tampering of said container can be essentially visually determined by bending of a body portion or bending of a strengthening and retaining frame forming part of the container, said container comprising in combination a knock-down body portion forming a cavity to retain a commodity therein, said body portion being of one piece construction formed as a self supporting material and having at least four (quadrilaterally) rectangularly arranged body-forming walls, and each of said body-forming walls having end margins thereon, said body portion having an aperture formed in the end margins of said walls communicating with said cavity to permit loading of a commodity therein, a first flap extending from the end margin on a first of said body-forming walls and capable of being struck in a direction where it lies substantially in a juxtaposition to the exterior surface of said first body-forming wall, a second flap extending from the end margin on a second of said body-forming walls substantially opposed to the first of said body-forming walls and capable of being struck in a direction where it lies substantially in juxtaposition to the exterior surface of said second body-forming wall, closure means operatively associated with said body portion to extend in closurewise position over said aperture, said closure means comprisiing a (quadrilaterally) rectangularly shaped strengthening and retaining frame of one piece construction which has a shape substantially conforming to the shape of said body portion, said strengthening and retaining frame having a continuous side wall formed of a reinforcing material, first and second flanges extending inwardly substantially perpendicularly from said side wall and being spaced apart from each other by a distance approximately equal to the length of either of said first or second flaps, said first and second flaps each having a depth approximately equal to the depth of the side wall of said strengthening and retaining frame, said side wall of said strengthening and retaining frame being substantially parallel to said first and second body-forming walls when said closure means is in the closurewise position, the end margins of said first body-forming wall engaging the first flange on said side wall and the outer end of said first flap snuggly engaging the second flange on said side wall when said strengthening and retaining frame is assembled with said body portion, said first flange snuggly engaging the end margins of said first and second body-forming walls sufficiently to prevent play or free movement of the strengthening and retaining frame when surrounding the container body portion, the end margin of said second body-forming wall also engaging the first flange on said side wall when said member is assembled with said body portion, each of said first and second flaps being located in somewhat parallel relationship to said respective first and second body-forming walls but being slightly angularly located with respect to said body-forming walls when the closure means is shifted to the closurewise position, said second flange having a bearing surface which faces the first flange and retentively engaging the outer end of said first flap, siad bearing surface having a width substantially greater than the thickness of the outer end of said first flap, said end margin on said first body-forming wall engaging said side wall and being retained by said side wall and said first flange when said strengthening and retaining frame is assembled with said portion, said relatively slight angular relationship of said first flap to said first body-forming wall increasing the locking strength of said flap to said strengthening and retaining frame, and extended portion on said second flap which extends beyond the second flange on said side wall which is capable of being manually grasped and pulled for permitting removal of the strengthening and retaining frame from the body portion.

* * * * *